US008814476B2

(12) United States Patent
Åberg et al.

(10) Patent No.: US 8,814,476 B2
(45) Date of Patent: Aug. 26, 2014

(54) METHOD, SYSTEM, USE OF THE SYSTEM AND REINFORCEMENT MEMBER FOR ROCK REINFORCEMENT

(75) Inventors: Sture Åberg, Luleå (SE); Leif Gustafsson, Luleå (SE)

(73) Assignee: Malmafälten AB, Luleå (SE)

( * ) Notice: Subject to any disclaimer, the term of this patent is extended or adjusted under 35 U.S.C. 154(b) by 367 days.

(21) Appl. No.: 13/318,776

(22) PCT Filed: May 5, 2010

(86) PCT No.: PCT/SE2010/050497
§ 371 (c)(1), (2), (4) Date: Nov. 3, 2011

(87) PCT Pub. No.: WO2010/128943
PCT Pub. Date: Nov. 11, 2010

(65) Prior Publication Data

US 2012/0048009 A1 Mar. 1, 2012

(30) Foreign Application Priority Data

May 6, 2009 (SE) ..... 09006180

(51) Int. Cl.
*E21D 20/02* (2006.01)

(52) U.S. Cl.
USPC ..... 405/259.5

(58) Field of Classification Search
CPC ..... E21D 20/028; E21D 20/02
USPC ..... 405/259.1–259.6; 73/152.57
See application file for complete search history.

(56) References Cited

U.S. PATENT DOCUMENTS 585,057 A * 6/1897 Stone ..... 138/111
2,163,449 A * 6/1939 Owsley et al. ..... 166/281
(Continued)

FOREIGN PATENT DOCUMENTS

WO WO 2009079684 A1 * 7/2009 ..... E21D 20/02

OTHER PUBLICATIONS

International Search Report and Written Opinion received for PCT Patent Application No. PCT/SE2010/050497, mailed on Aug. 12, 2010, 9 pages.

(Continued)

*Primary Examiner* — John Fitzgerald
(74) *Attorney, Agent, or Firm* — Morrison & Foerster LLP

(57) ABSTRACT

The present invention concerns a method, a system, the use of the system and a reinforcement member for the direct detection of the presence of a cavity in a drill-hole intended for the reception of a reinforcement member. The method comprises the injection of a drill-hole with hardening grout 6, the introduction of a reinforcement member 7, 40 to introduce a pressurized medium 37 and the measurement of the change in pressure or the detection of a flow of medium, whereby the fall in pressure or the presence of a flow of medium indicates the presence of a cavity. The system comprises a container 26 comprising a pressurised medium 37, a reinforcement member 7, 40 comprising a channel 15, 41 through which the pressurised medium in the container is added to the drill-hole at the presence of a cavity, and a pressure gauge 27 or a flow meter 50, where the pressure gauge measures a change in pressure or the flow meter detects a flow of medium, whereby a fall in pressure or a flow of medium indicates the presence of a cavity. The invention is used during the construction of tunnels and mines in order to ensure the quality of rock reinforcement that has been carried out.

25 Claims, 11 Drawing Sheets

(56) References Cited

U.S. PATENT DOCUMENTS

| | | | | | |
|---|---|---|---|---|---|
| 2,331,185 | A | * | 10/1943 | Gordy | 166/120 |
| 3,212,269 | A | | 10/1965 | Olsen | |
| 3,234,742 | A | | 2/1966 | Williams | |
| 4,062,229 | A | | 12/1977 | Godfrey et al. | |
| 4,644,712 | A | * | 2/1987 | Watson | 52/162 |
| 4,725,169 | A | * | 2/1988 | Tazawa et al. | 405/269 |
| 4,974,997 | A | * | 12/1990 | Sero et al. | 405/231 |
| 5,992,103 | A | * | 11/1999 | Norman et al. | 52/155 |
| 6,042,018 | A | * | 3/2000 | Weinstein | 239/33 |
| 2005/0011265 | A1 | | 1/2005 | Brink et al. | |
| 2011/0070035 | A1 | * | 3/2011 | Ricardo | 405/259.5 |
| 2012/0048009 | A1 | * | 3/2012 | Berg et al. | 73/152.51 |

OTHER PUBLICATIONS

International Preliminary Report on Patentability received for PCT Patent Application No. PCT/SE2010/050497, issued on Nov. 9, 2011, 6 pages.

* cited by examiner

METHOD, SYSTEM, USE OF THE SYSTEM AND REINFORCEMENT MEMBER FOR ROCK REINFORCEMENT

CROSS REFERENCE TO RELATED APPLICATIONS

This is a U.S. National Phase patent application of PCT/SE2010/050497, filed May 5, 2010, which claims priority to Swedish Patent Application No. 0900618-0, filed May 6, 2009, each of which is hereby incorporated by reference in the present disclosure in its entirety.

TECHNICAL AREA

The present invention concerns a method, a system, the use of the system and a reinforcement member for the direct detection of the presence of a cavity in a drill-hole intended for the reception of a reinforcement member.

THE PRIOR ART

A large number of reinforcement systems are today available to stabilise and reinforce a rock structure during the building of tunnels, mining operations, tunnelling, etc. Such a reinforcement system involves the drilling of a large number of drill-holes in the wall or roof that is to be reinforced, the subsequent filling of these drill-holes with grout, and the subsequent introduction of bolts into them, to be cast in place in the drill-holes, by which means the wall or roof is reinforced. One example of a bolt for casting into a reinforcement system is what is popularly called the "kiruna bolt", which consists of a reinforcement bar with an end demonstrating a slot. Another example is a cable bolt, which consists of a 7-strand twisted steel thread. These types of bolt have lengths of 3-7 meters.

The rock reinforcement is carried out through a portion of the grout being injected into a drill-hole with a nozzle, normally a tube. The drill-hole is filled from the deepest part of the drill-hole bottom, after which the tube is withdrawn, during filling. The grout then runs downwards in the direction towards the opening of the drill-hole, particularly in those drill-holes that have been drilled in tunnel roofs. Rock material may be constituted in different ways: cracks and natural cavities are sometimes present that are filled by an injected portion of grout. This means that the portion of grouting that has been injected is insufficient to anchor the rock bolt, and this results in a deficient reinforcement system. When the rock bolt is introduced into what appears to be a filled hole, there may, therefore, arise compartments, cavities, along the bolt that are difficult to detect. These cavities, in particular, usually arise at the extreme end, at the deepest part of the drill-hole. A serious problem with these reinforcement systems, therefore, is that it is not possible to be certain that any individual bolt is completely cast and well-anchored. The greatest problem arises if the uppermost part of the bolt is not covered by hardening grout. A part of the tensile strength of the bolt will in this case be lost. Furthermore, the risk for corrosion of the bolt increases, since the rock in itself may be wet. There are no direct methods for cast bolts that can detect whether any cavities are present after the hardening grout and the bolt have been introduced into the drill-hole.

A previously known method of investigation to check the attachment of the bolt involves testing the tensile resistance of the cast bolt. A second method of investigation involves the transmission of sound waves through the bolt and the detection of cavities or breaks in the bolt being detected from the manner in which the waves are reflected. The indirect methods of investigation mean that it is not possible to verify with certainty whether grout is missing from the drill-hole.

DESCRIPTION OF THE INVENTION

The purpose of the invention is to offer a method for the direct detection of the presence of a cavity in a drill-hole, which makes it possible to verify whether grout is missing in the drill-hole following the execution of rock reinforcement, and thus to ensure that a reinforcement system consisting of cast bolts satisfies the relevant safety requirements and regulations for strength. To be more specific, the invention demonstrates how the presence of a cavity at the far end of a drill-hole is detected and measured following the execution of rock reinforcement. This purpose is achieved with a method for the direct detection of the presence of cavities in drill-holes according to claim 1, a system for the direct detection of the presence of cavities in drill-holes according to claim 10 and the use of the said system according to claim 19, and with the reinforcement member for use during direct measurement according to claim 20.

A first aspect of the invention thus comprises a method for the direct detection of the presence of a cavity in a drill-hole intended for the reception of a reinforcement member, whereby the said method comprises that a hardening grout is injected into the drill-hole, that a reinforcement member is introduced into the drill-hole, that a pressurised medium is introduced into the drill-hole and to measure changes in pressure in the medium or to detect flow of the medium, whereby a fall in pressure or the presence of flow in the medium indicates the presence of a cavity. It is preferable that the reinforcement member comprise a channel through which the pressurised medium is added to the drill-hole at the presence of a cavity. It is preferable that the said channel be surrounded by a tube wall, where the tube wall is provided with at least one radially directed hole in order to introduce the pressurised medium into the drill-hole at the presence of a cavity. It is preferable that the radially directed hole be covered by a cover before the reinforcement member and the channel are introduced into the drill-hole. The channel can be attached to the reinforcement member before the reinforcement member is introduced into the drill-hole.

A second aspect of the invention comprises a system for the direct detection of the presence of a cavity in a drill-hole intended for the reception of a reinforcement member whereby the said system comprises an extended reinforcement member, at least one of a pressure gauge and a flow meter, and a container comprising a pressurised medium, where the reinforcement member comprises a channel through which the pressurised medium in the container is supplied to the drill-hole in the presence of a cavity, and either that the pressure gauge measures a change in pressure of the medium or that the flow meter detects flow of the medium, or both, where a fall in pressure or the presence of flow indicates the presence of a cavity. It is preferable that the said channel be surrounded by a tube wall, where the tube wall is provided with at least one radially directed hole through which the pressurised medium is introduced into the drill-hole at the presence of a cavity. In one embodiment of the system the channel has the form of a tube and is attached to the reinforcement member. In an alternative embodiment the reinforcement member consists of a tubular reinforcement member in which the channel is an integral part of the reinforcement member. In a further alternative embodiment of the system, the reinforcement member has a wave form along a part of its length.

A third aspect of the invention comprises the use of a system as that described above.

A fourth aspect of the invention comprises a reinforcement member for use for the direct detection of the presence of cavities in drill-holes intended for the reception of reinforcement member, whereby the reinforcement member comprises a channel for the introduction of a medium into the drill-hole. The reinforcement member may consist of a tubular reinforcement member into which the channel has been integrated.

Further advantages and positive effects of the invention will be described below based on several embodiments of the invention and with reference to the drawings.

DETAILED DESCRIPTION OF THE INVENTION

The invention will be illustrated through the following embodiments.

Figures 1A, 1B, 1C, 1D:
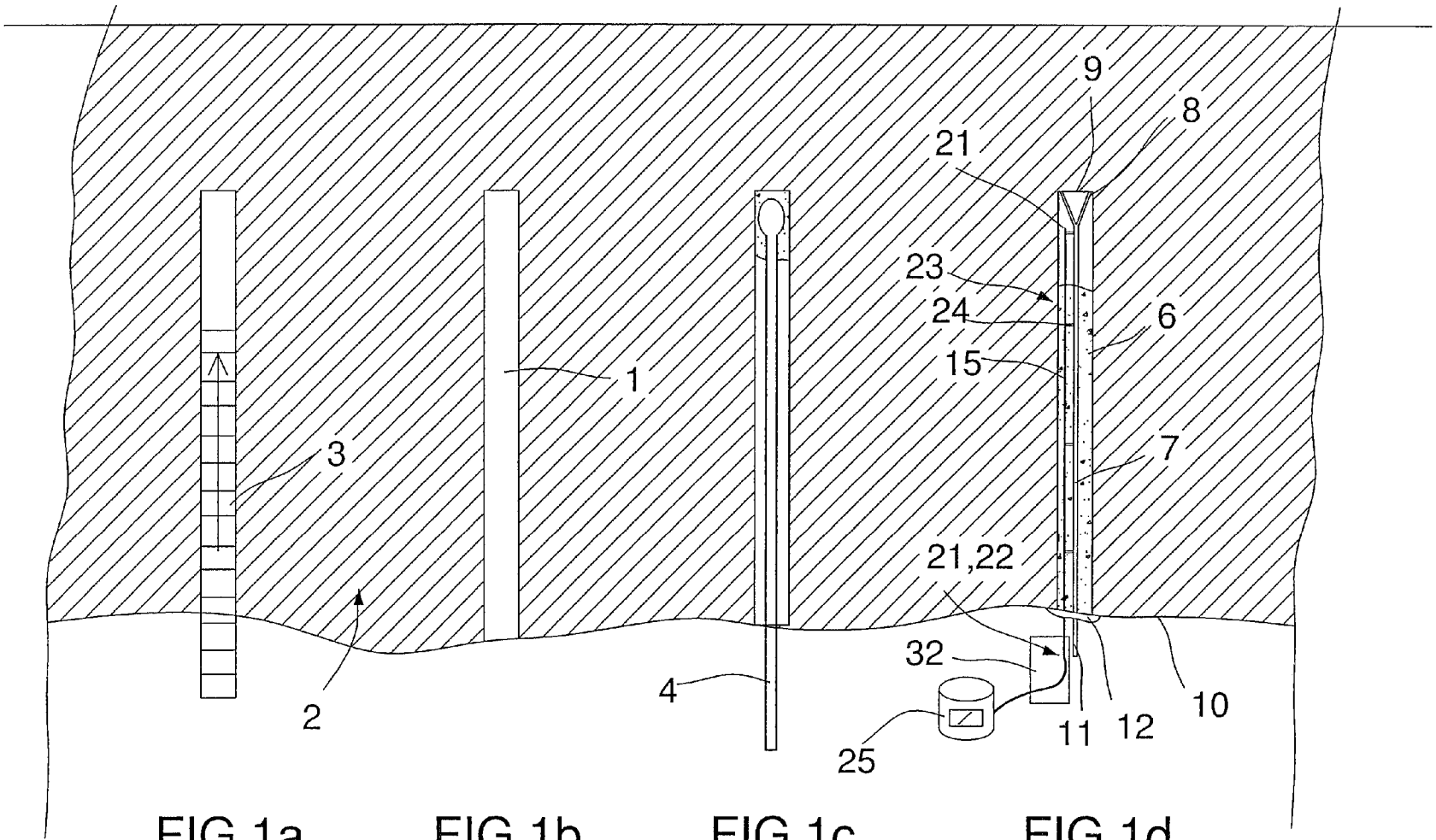
FIGS. 1*a-d* illustrate schematically a method according to the invention.

FIGS. 1*a-d* illustrate schematically the execution of rock reinforcement in a tunnel or mine with a first embodiment of the system according to the invention. According to FIG. 1*a*, the rock reinforcement starts with the drilling of an axially extended drill-hole 1 into a rock structure 2 with a rock drill 3, the drilling is carried out into all surfaces that require reinforcement, in particular into the roof surfaces of a tunnel or mine. FIG. 1*b* shows the drilled hole 1, the depth of which is 3-7 meters. FIG. 1*c* shows an injection nozzle 4, consisting of a tube or flexible pipe, introduced into the bottom of the drill-hole 1. A portion of hardening grout 6 is injected by the injection nozzle 4, which is preferably withdrawn from the drill-hole 1 while injection is taking place in order to obtain an advantageous distribution of the grout 6. The term "hardening grout" is here used to denote sealing compound, concrete, cement or similar hardening material. FIG. 1*d* shows the completed grouting operation. FIG. 1*d* shows also a reinforcement member 7, an axially extended body, such as, for example, a kiruna bolt, consisting of a reinforcement bar with an end demonstrating a slot, introduced into the drill-hole that has been filled by grout 6 such that the bottom end 8 of the reinforcement member is in the neighbourhood of or in direct contact with the bottom 9 of the drill-hole. The reinforcement member 7 may consist also of a twisted cable bolt or of some other type of rock bolt (not shown in the drawing). The reinforcement member is manufactured from iron material, preferably steel.

It is preferable that the reinforcement member 7 have a length that is greater than the depth of the drill-hole. The reinforcement member 7 extends out of the drill-hole 1 at the surface 10 of the rock structure.

FIG. 1*d* shows an anchor arrangement 12. The anchor arrangement 12 is brought into contact with the surface end 11 of the reinforcement member. The anchor arrangement has been adapted such that it anchors the reinforcement member, in a manner familiar to one skilled in the arts. The reinforcement member 7 is in this way anchored in a secure manner after the rock reinforcement has been carried out before the grout 6 has become fully hardened.

The anchor arrangement may comprise also an opening for the penetration of a channel that is separated from the reinforcement member.

Figure 2:
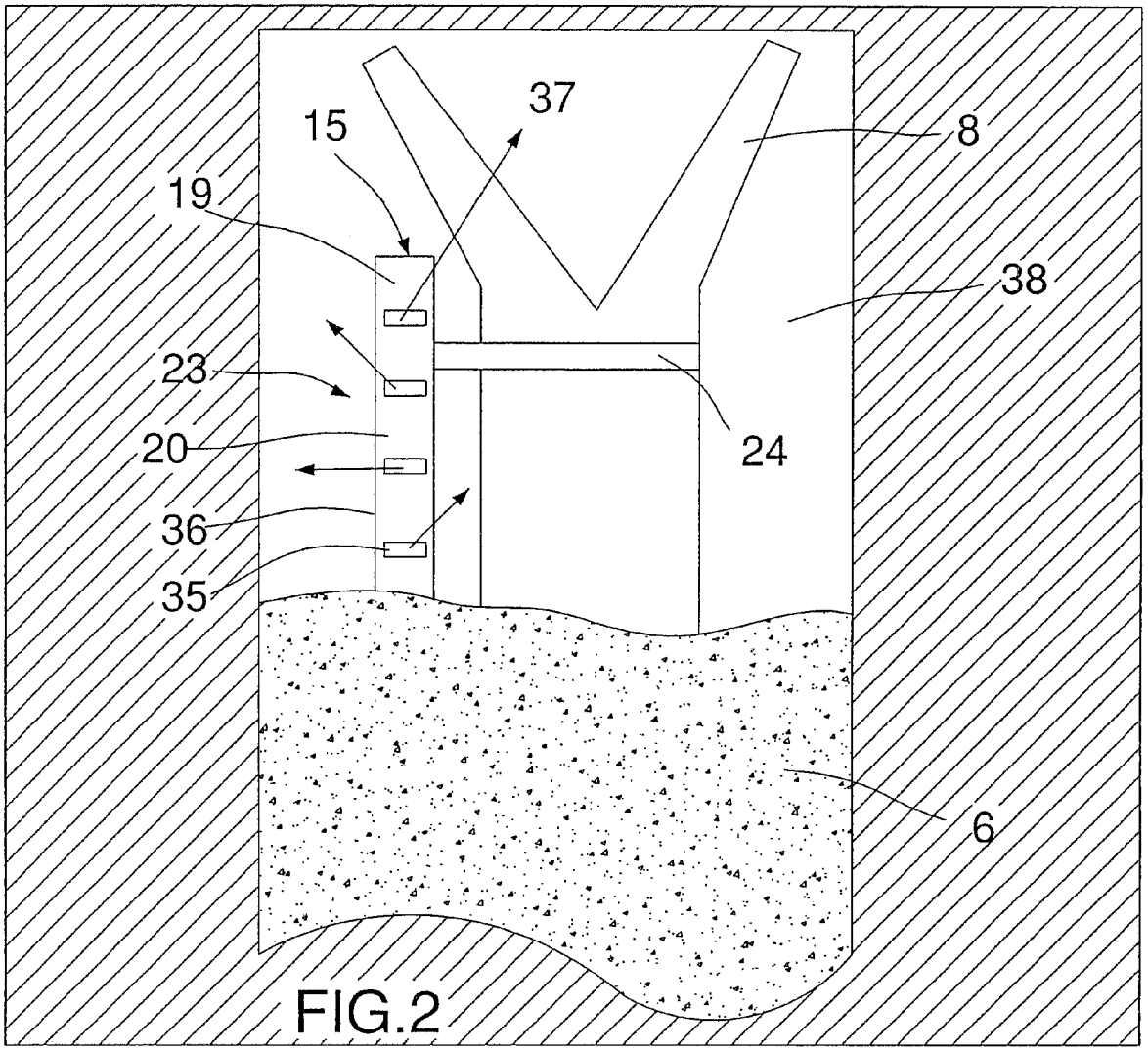
FIG. 2 illustrates a reinforcement member with a channel introduced into a drill-hole according to a first embodiment of the invention.

It is furthermore shown in FIG. 1*d* and FIG. 2 that the reinforcement member 7 is provided with a separate channel 15. It is intended that the channel 15 be introduced into a pressurised medium in a drill-hole that has been filled or partially filled by hardening grout. The channel 15 is constituted by a thin, hollow tube 19 that is open in its longitudinal direction, made from, for example, semi-rigid metal, semi-rigid flexible plastic, or semi-rigid flexible rubber. The semi-rigid property of the tube relates to its stability in the transverse direction. The tube 19 has a wall 20. The thickness of the tube wall 20 is selected such that any externally applied load from hardening grout 6 and similar does not influence the function of the channel.

The tube 19 and the channel 15 are provided with at least one channel opening 21 in at least one tube end. It is preferable that the tube 19 and the channel 15 are provided with at least one channel opening 21 at each tube end. The channel opening 21 is intended for insertion into a medium in the drill-hole 1.

The diameter of the tube 19 is considerably smaller than the diameter of the reinforcement member 7. The tube 19 and the channel 15 have essentially the same length, or they are longer than the reinforcement member 7. The length of the tube 19 thus exceeds the depth of the drill-hole.

The channel 15 has an inner end 23 that is located close to the bottom end 8 of the reinforcement member and close to the bottom 9 of the drill-hole. The tube 19 and the channel 15 have a contact end 22 that protrudes out from the drill-hole 1.

The tube 19 and the channel 15 are fixed, mounted, at the reinforcement member 7 by one or several fixture arrangements 24. The fixture arrangements 24 are, for example, regularly distributed along the length of the tube 19 and the reinforcement member 7. The fixture arrangement 24 consists of, for example, a twisted steel wire or similar.

The channel 15 can be fixed to the reinforcement member 7 during the production of the reinforcement member, particularly if the reinforcement member is an independent bolt such as a kiruna bolt. If the reinforcement member is a twisted bolt, the length of the bolt is adapted immediately before the rock reinforcement operation is carried out. The reinforcement member is manufactured from metal, for example steel. The tube 19 and the channel 15 are then fixed to the reinforcement member before the reinforcement member 7 and the tube 19 are introduced into, pressed up into, the drill-hole 1, that has been filled with hardening grout 6. FIG. 1*d* illustrates further that the contact end 22 of the tube is available after the anchoring for connection to measurement equipment 25. The measurement equipment will be described in more detail below.

FIG. 2 illustrates a feature of the tube 19 with the channel 15 introduced into a drill-hole 1 according to a first embodiment of the invention. The drill-hole is only partially filled with grout 6, and a cavity 38, an unfilled compartment, has been formed at the bottom of the drill-hole. The tube 19 with the channel 15 are provided with at least one hole 35 in the wall 20 of the tube. The hole 35 may be, for example, a perforation or a transverse channel. The tube wall 20 can be provided with several holes 35 along its complete length and around its complete circumference. It is preferable that the tube wall be provided with several holes 35 close to the innermost end 23, as shown in FIG. 2. The holes 35 unite the channel 15 with the outer surface 36 of the tube wall. The channel 15 and the holes 35 are intended to introduce a medium into the cavity in the drill-hole, on the outer surface of the tube 19. FIG. 2 shows the tube 19 with rectangular holes 35. The tube is fixed to the reinforcement member 7 with a fixture arrangement 24. The reinforcement member 7 makes contact with the bottom 9 of the drill-hole. The tube 19 with the reinforcement member 7 have been introduced into the drill-hole 1, which is partially filled by hardening grout 6. Pressurised medium 37 flows through the holes 35 into the cavity 38. The pressurised medium 37 is supplied to the cavity from measurement equipment 25 through the open channel 15 and the holes 35 (not illustrated in this figure).

Figure 3A:
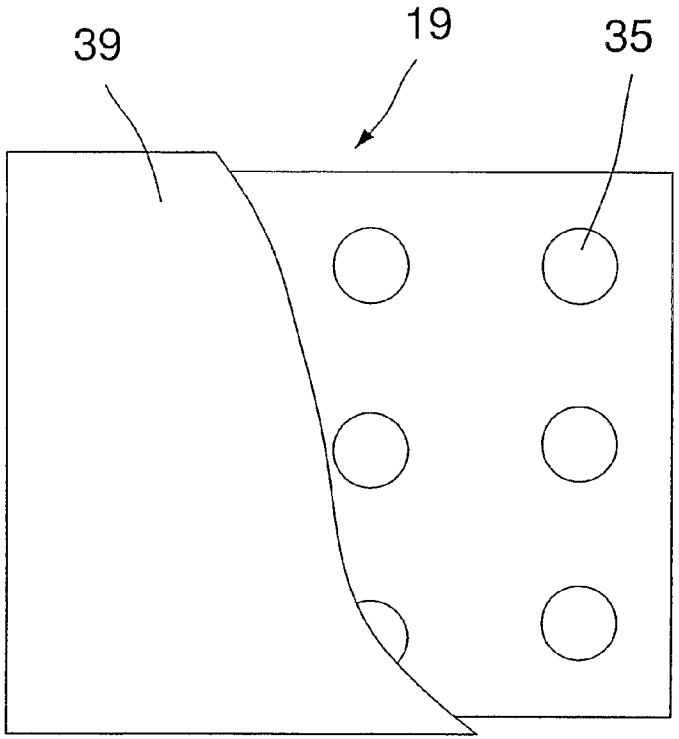
FIGS. 3*a-b* illustrate a side view and a cross-section of a feature of the first embodiment according to the invention.
Figure 3B:
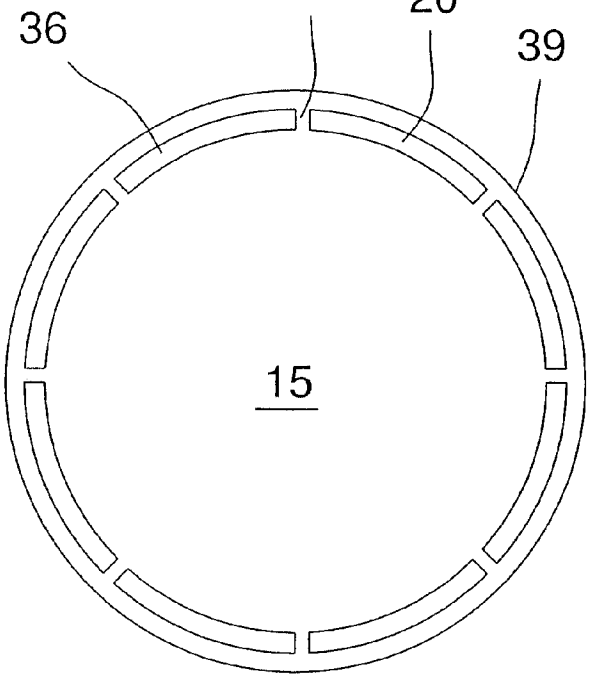

FIGS. 3*a* and 3*b* illustrate a further feature of the tube 19 and the channel 15. It is here shown how the holes, the perforations, are regularly distributed along the length and around the circumference of the tube, as shown in FIG. 3*b*. The holes 35 may, of course, be irregularly distributed along the length and around the circumference, with retained function. The holes 35 may be of mutually different sizes and designs: they may be, for example, round, square or they may have the form of slits. It is preferable that the holes 35 have the same size and design, as shown in FIG. 3*a*.

FIG. 3*b* shows how the holes 35 are directed in the radial direction of the tube. The holes 35 are, in a second variant, directed away from the drill-hole 1 (not shown in the figures) in order to avoid them being clogged by unhardened grout when the tube 19 and the channel 15 are introduced into the drill-hole 1 together with the reinforcement member 7.

Another way to avoid the holes 35, the perforations, being clogged by unhardened grout is to provide the perforated tube 19 with a cover 39 before it is introduced into the drill-hole together with the reinforcement member 7. The cover 39 is constituted by a thin layer of material, such as, for example a thin expandable rubber sheet having the properties of a balloon, a plastic film, or a thin sheet of paint or tape.

It is intended that the cover 39 cover the holes 35 loosely. If the cover is constituted by an expandable rubber sheet or plastic film, the cover can be drawn over the tube 19 and the channel 15 immediately before the introduction of the tube into the drill-hole. The cover may, of course, be placed on the tube during simultaneous production of the reinforcement member and the tube. If the cover is a painted cover, the tube 19 can be painted before it is fixed to the reinforcement member 7. The cover 39 protects the holes 35 from becoming clogged with unhardened grout during the introduction of the tube 19 into the drill-hole 1. The material of the cover is designed such that the cover does not break when it is introduced into the drill-hole. The cover 39 is pressed, forced, away from the covered holes 35 that are adjacent to a cavity 38 in the drill-hole when a pressurised medium is introduced into the channel. The pressurised medium can in this way flow out of the holes 35 at the presence of a cavity and the measurement equipment can detect the cavity. The measurement equipment will be described in more detail below.

Figure 4B:
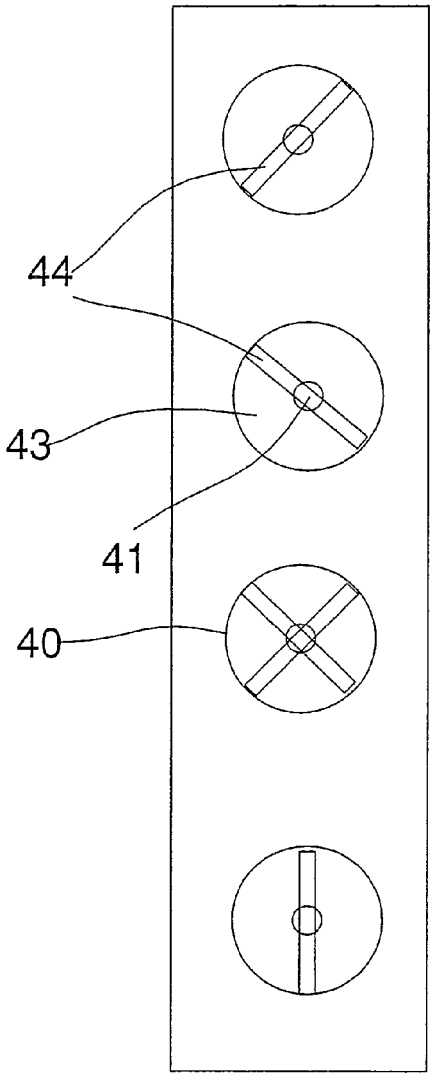
FIG. 4*b* illustrates four different cross-sections, with a detailed view of the transverse channels along the reinforcement member according to FIG. 4*a*.
Figure 4A:
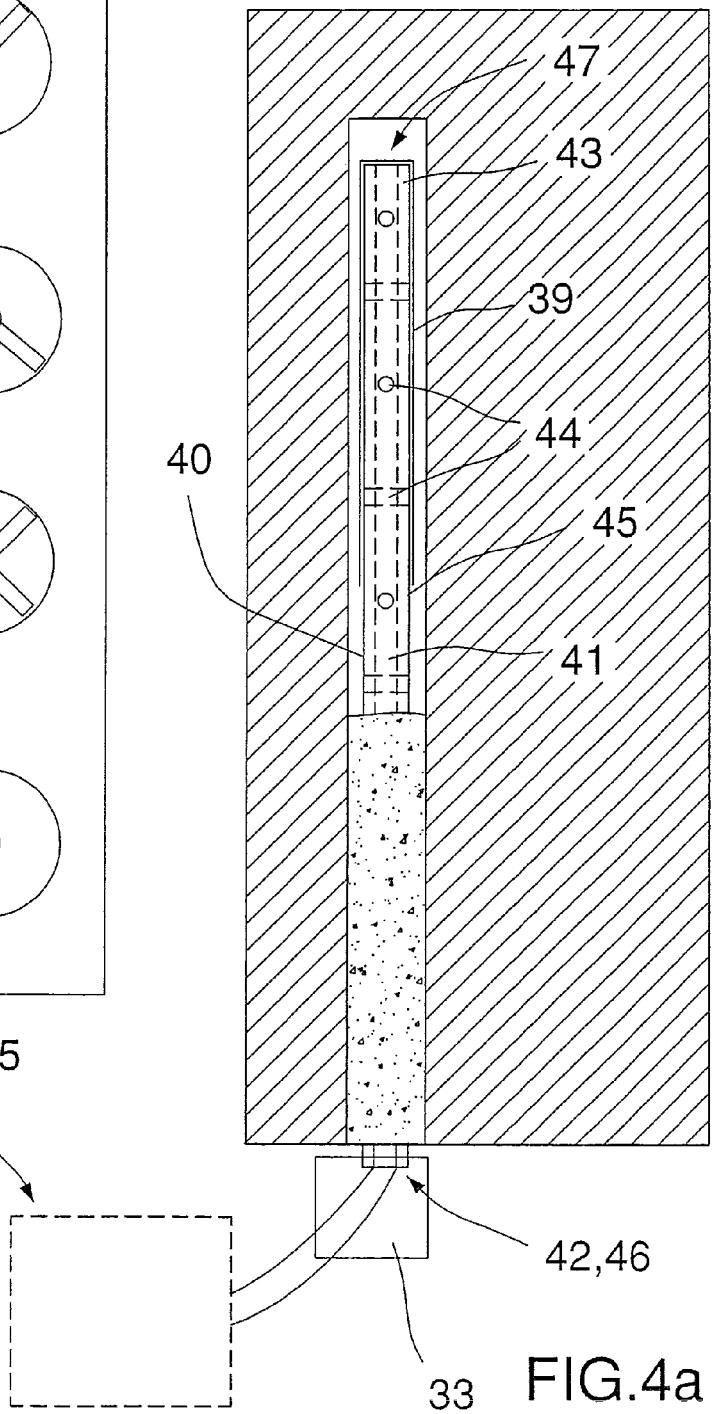
FIG. 4*a* illustrates schematically a reinforcement member with a channel introduced into a drill-hole according to a second embodiment of the invention.

FIG. 4*a* illustrates a second embodiment of the system according to the invention. The rock reinforcement according to this embodiment is carried out with an extended tubular reinforcement member 40. The tubular reinforcement member 40 comprises a channel 41 that is an integral part of the tubular reinforcement member.

The tubular wall 43 for this tubular reinforcement member is thick. The cross-sectional area of the tube wall corresponds to the cross-sectional area of a normal solid, not tubular, reinforcement member.

The channel 41 is extended and open throughout the complete length of the tubular reinforcement member and the channel. The channel 41 has at least one channel opening 42 in at least one end of the tubular reinforcement member. It is preferable that the channel 41 have a channel opening 42 at each end of the tubular reinforcement member. The tubular wall 43 for the tubular reinforcement member comprises, as is the case also for the first embodiment, at least one hole or transverse channel 44.

The tubular wall 43 for the tubular reinforcement member may also, of course, be provided with several transverse channels 44 along its complete length or parts of it, from the contact end 46 to the bottom end 47.

The transverse channels 44 may be regularly or irregularly distributed over the tube wall of the tubular reinforcement member. The transverse channels 44 may pass diametrically through the tube or they may be angled away from the drill-hole, in accordance with previous embodiments.

With reference to FIGS. 4*a* and 4*b*, the transverse channels 44 are angularly displaced around the circumference and distributed along the complete length of the tubular reinforcement member, as shown in FIG. 4*a*. The cross-sectional area of the transverse channels is considerably less than that of the channel 41. The transverse channels 44 unite the channel 41 with the outer surface 45 of the tubular reinforcement member. The channel 41 and the transverse channels 44 are intended to be introduced into a medium in a drill-hole 1 that is fully or partially filled with hardening grout at the presence of a cavity. The tube wall 43 of the tubular reinforcement member and the transverse channels 44 may, in accordance with the first embodiment, be covered by a cover 39 in order to avoid the transverse channels becoming clogged by unhardened grout. The tubular reinforcement member 40 may be anchored by an anchor arrangement 12 that is designed in a manner familiar to one skilled in the arts. Measurement equipment 25 is connected to the contact end 46 of the tubular reinforcement member using connectors 33 during measurement. Thus, a pressurised medium may be passed through the channel from a container to a cavity 38 that may be present, adjacent to the tubular reinforcement member. The outer surface of the tubular reinforcement member may be provided with protuberances in order to improve the adhesion and to increase the contact area with the grout.

The tubular reinforcement member 40 is manufactured from a material that is similar to the material of the previously described reinforcement member 7, such as steel.

The tubular reinforcement member 40 has several functions in this second embodiment of the system according to the invention. A first function is to reinforce the rock structure, a second function is to lead in a medium into the drill-hole through the integrated channel 41, at the presence of a cavity.

Figure 5:
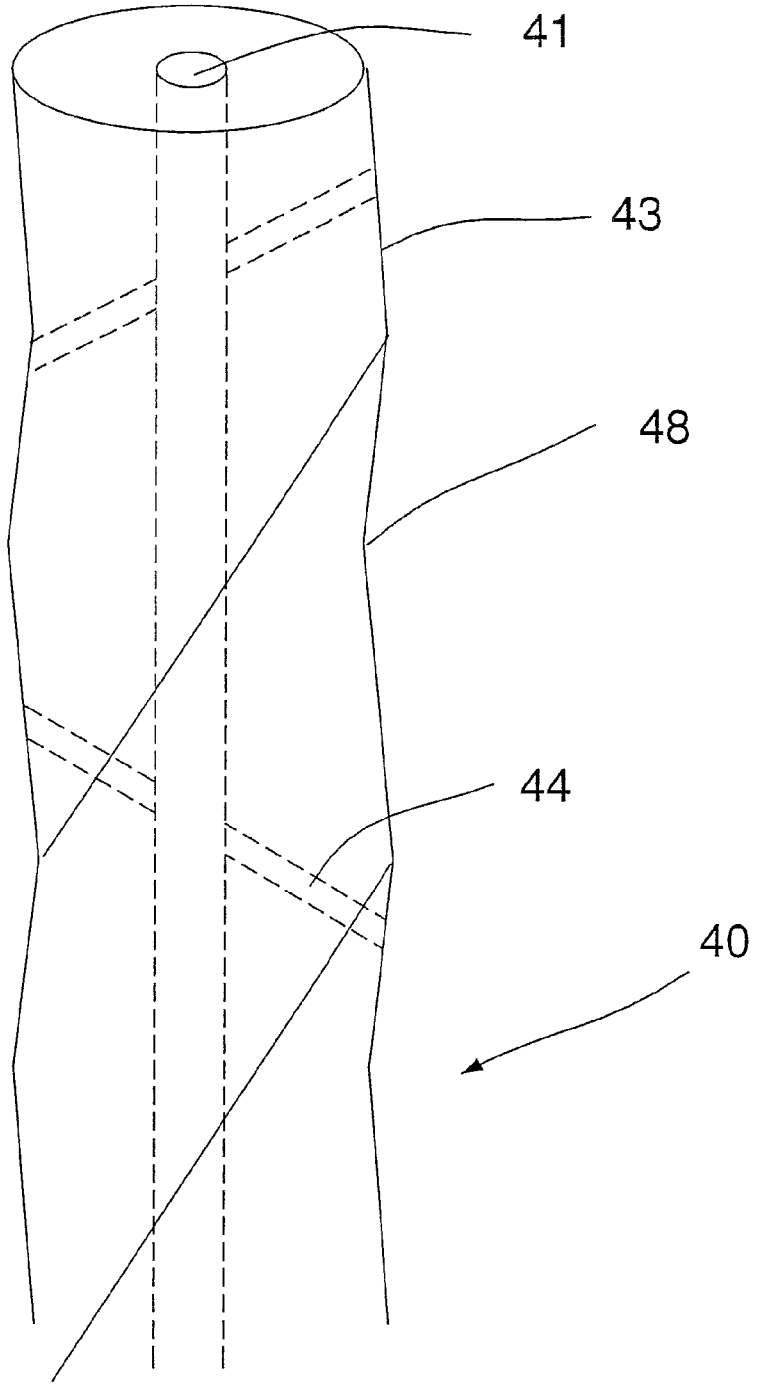
FIG. 5 illustrates schematically a side view of a reinforcement member according to a third embodiment according to the invention.

FIG. 5 shows a third embodiment of the system according to the invention.

The wall of the tubular reinforcement member 40 is, in accordance with the second embodiment described above, thick. The tubular reinforcement member 40 is provided with holes or transverse channels 44 along its complete length or parts of it, in accordance with the embodiments described previously. The tube wall 43 of the tubular reinforcement member is provided with deformations 48 along its complete length or parts of it. The deformations comprise inwardly facing indentations that face towards the channel. The indentations are produced by transverse compression of the tubular reinforcement member, where the compressions are exerted in alternating directions. The deformations 48 have the effect of providing a screw action when the tubular reinforcement member is introduced into the drill-hole. The introduction is carried out using a combined pressure and rotatory movement, which results in the grout being displaced inwards in the drill-hole. This leads to a more secure rock reinforcement and reduces the risk for the presence of cavities in the drill-hole. The channel is open and the deformations do not influence the function of the channel or the holes, that of introducing a medium into the drill-hole at the presence of a cavity. The tubular reinforcement member 40 can be anchored using an anchoring means 12 of a type similar to those described previously. Measurement equipment 25 is connected to the contact end 46 of the tubular reinforcement member using connectors 33 during measurement. Thus, a pressurised medium may be passed through the channel from a container to a cavity 38 that may be present, adjacent to the tubular reinforcement member.

Figure 6:
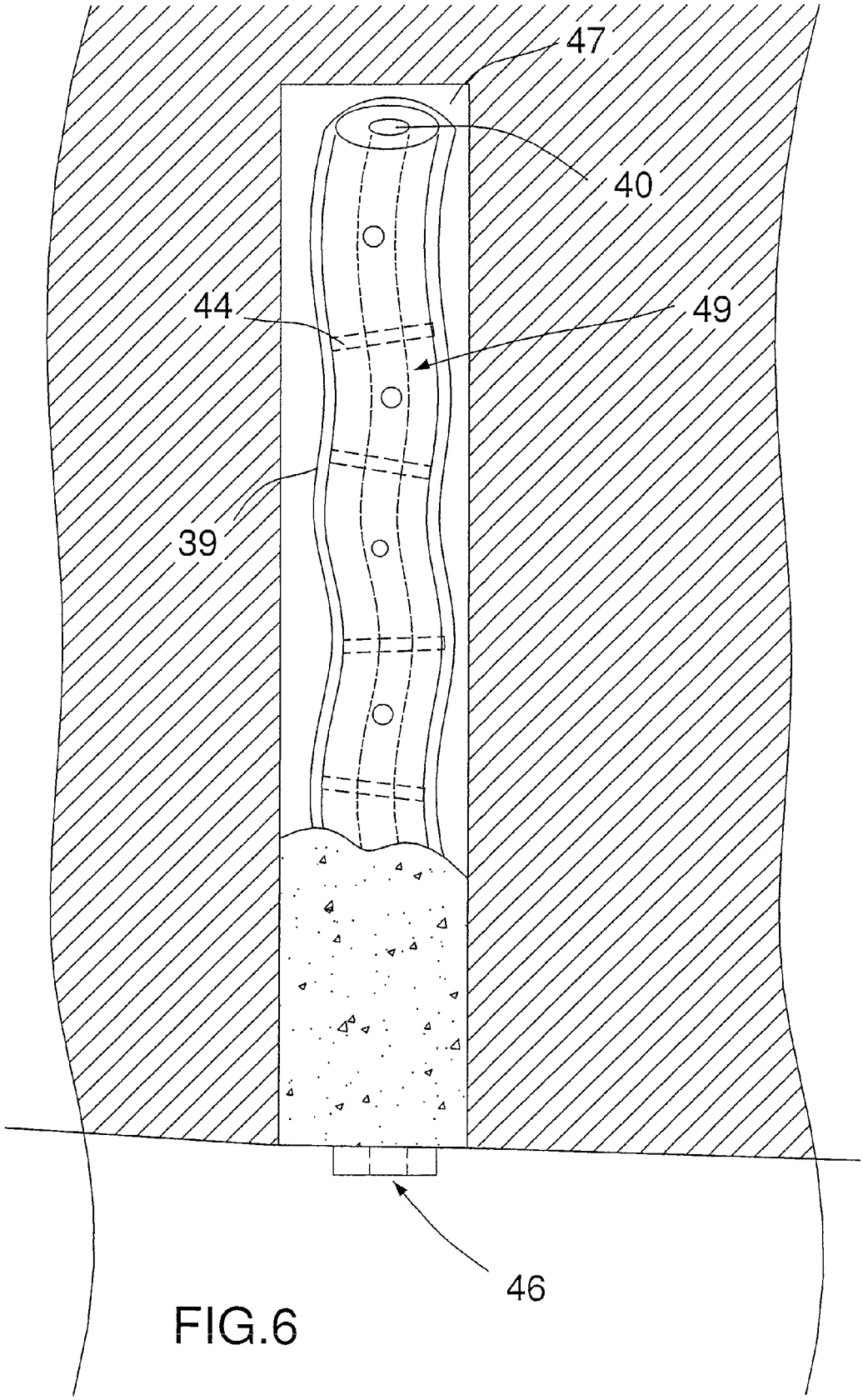
FIG. 6 illustrates schematically a side view of a reinforcement member according to a fourth embodiment according to the invention.

FIG. 6 shows a fourth embodiment of the system according to the invention. The tube wall of the tubular reinforcement member is, in accordance with the other embodiments described above, thick. The tubular reinforcement member 40, and the channel and transverse channels, are wave-shaped along their complete lengths or parts of them from the contact end 46 to the bottom end 47. The wave-form 49 describes a sine wave, and it may be regular or irregular. It is preferable that the wave-form be regular. The amplitude of the wave-form 49 is less than the diameter of the drill-hole. The tubular reinforcement member, the channel and the transverse channels have the same functions as those described previously. The tubular reinforcement member 40 may also be provided with deformations 48 as has been described above. The length of the tubular reinforcement member exceeds the depth of the drill-hole. The contact end 46 of the tubular reinforcement member extends outside of the drill-hole 1 when the tubular reinforcement member has been introduced into the drill-hole and its bottom end 47 is in contact with, or in the close vicinity of, the bottom 9 of the drill-hole. The tubular reinforcement member 40 is anchored using an anchoring means 12 of a type similar to those described previously. Measurement equipment 25 is connected to the contact end 46 of the tubular reinforcement member using connectors 33 during measurement. Thus, a pressurised medium may be passed through the channel and the transverse channels to a cavity 38 that may be present, adjacent to the tubular reinforcement member.

Figure 7:
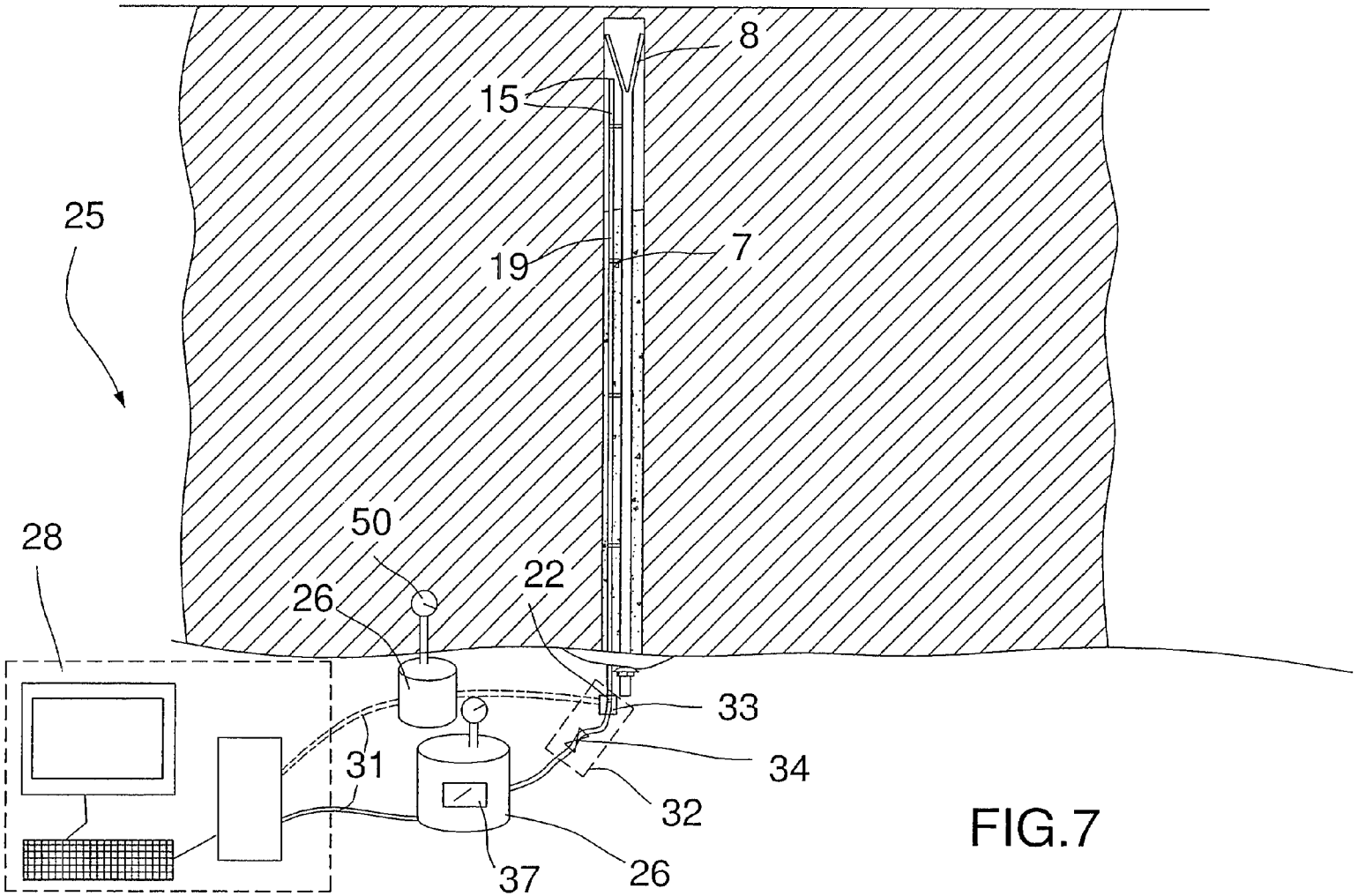
FIG. 7 illustrates the measurement equipment for the detection of the presence of a cavity in a drill-hole.

FIG. 7 shows measurement equipment 25 intended to be used for the detection of the presence of a cavity in a drill-hole 1. The measurement instrument comprises a container 26, an evaluation unit 28, and one or several of the following measurement instruments: a pressure gauge 27 and a flow meter 50. The choice of measurement instrument depends on the choice of medium used. A pressure gauge or flow meter is used if the medium is a gas, for example air.

A flow meter is used if the medium is a liquid, for example water.

The container 26 comprises a vessel containing a pressurised medium 37, for example a closed pressure vessel or a compressor with pressurised air. Alternatively, a pressurised liquid, for example water, may be used. The measurement equipment is then provided with also pressurising means, such as a pump or similar. The medium in the container has an excess pressure that corresponds to 0.5-4 bar, preferably 0.5-2.0 bar. The measurement equipment 25 is furthermore provided with a tube 31 and a connector 32 in order to connect the container 26 to the contact end 22, 46 of the tube in a manner that allows it to be disconnected.

The connector 32 comprises coupling units 33 adapted for the temporary coupling of tubes, and it comprises flow-regulation devices 34, such as valves.

The evaluation unit 28 comprises, for example, a computer with display screen, processor and software.

In order to investigate the presence of cavities in drill-holes in a simple manner, the measurement equipment is composed of arrangements that can be easily carried by one person, and displaced within the tunnels and mines in which the rock structure is reinforced. The measurement equipment may also be placed onto a vehicle.

Figure 8C:
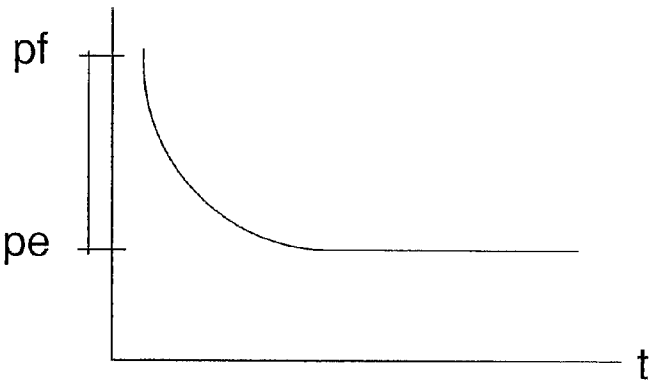
FIGS. 8*a-c* illustrate schematically the detection of the presence of a cavity in a drill-hole according to the method according to the invention.
Figure 8B:
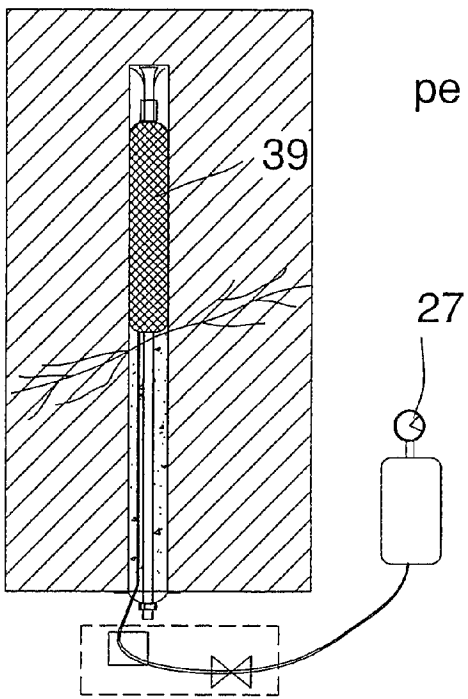
Figure 8A:
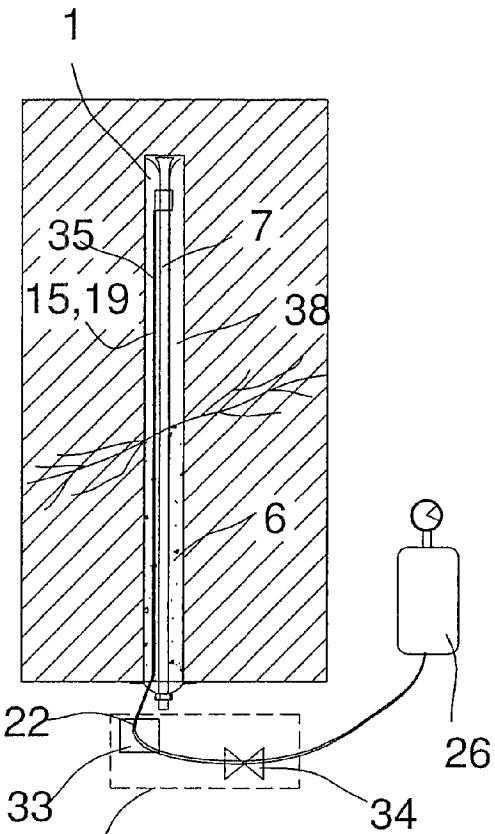

FIGS. 8*a-c* illustrate how the method for the direct detection is a cavity is carried out. The surface of the rock structure is divided into test areas and the rock reinforcement is carried out using conventional reinforcement members, for example kiruna bolts, and using reinforcement members comprising a channel according to the present invention. The density of the rock reinforcement system is determined based on experience. Once the rock reinforcement has been carried out, and the grout has completed the hardening process, the measurement equipment is temporarily connected to the channel in order to detect the presence of a cavity.

FIG. 8*a* shows a reinforcement member 7 with a channel 15, introduced into a drill-hole 1. The drill-hole is only partly filled by hardening grout, and a cavity is present close to the bottom of the drill-hole. The measurement equipment with the container 26 is connected to the contact end 22 of the channel using the connector 32. The container 26 contains a pressurised medium 37, for example air or water. It is preferable that air be used as medium since it is easier to handle and causes less damage if it should be the case that the rock structure is in very poor condition. It should be remembered that air is an expansive medium, and this aspect is advantageous. In addition, it is easier, simpler and more rapid to carry out measurement using a portable arrangement for the compression of air.

Practical experience has shown that it is advantageous that the pressurised medium comprises nitrogen gas. It is preferable that the pressurised medium consist solely of nitrogen gas. Nitrogen gas is advantageous since it is free of moisture and its behaviour is closer to that of an ideal gas than the behaviour of air.

As is shown in FIG. 8*b*, a valve 34 in the connector is opened, and medium flows into the channel 15 and through the holes 35. The covering cover 39 is expanded or pressed away, or it is destroyed by the pressurised medium. The medium thus penetrates out into the cavity 38 that is present in the direct vicinity of the tube 19. When a gaseous medium is used and the measurement equipment is provided with a pressure gauge 27, the pressure gauge records a change in pressure in the form of a fall in pressure in the medium. This information is transferred to the evaluation unit and its processor. The fall in pressure continues until the pressure in the medium has fallen and been normalised. The fall in pressure indicates the presence of a cavity. The measurement equipment and the connector are subsequently disconnected from the contact end 22.

This is illustrated in FIG. 8*c* where the evaluation unit 28, the computer, has processed the information and displays a graph, a specific curve, for the fall in pressure that has been measured. The appearance of the curve indicates the presence of cavities in the drill-hole. The lower level of pressure, $p_e$, can be used to calculate the magnitude of the volume of the cavities.

In the case in which a liquid medium such as water is used, the measurement equipment may be provided with a flow meter 50. The liquid, water, that is introduced into the channel is measured by the flow meter, which indicates whether or not a flow of medium is being introduced into the channel from the container. If flow is taking place, the volume of the flow can be recorded by the flow meter. A flow of medium indicates the presence of a cavity. The volume of the flow gives the volume of the cavity. If no change in pressure or flow of medium is measured, the rock reinforcement is assessed as fulfilling the requirements for strength and safety.

It has turned out to be the case, surprisingly, that the specific curve that is produced in order to display the change in pressure that is illustrated in FIG. 8*c* can be used also to classify one or several cracks in the rock structure 2 next to the drill-hole 1. The same is true, naturally, also for a specific curve for the flow of medium (not shown in the drawings). When measurement for the direct detection of cavities in the drill-hole 1 according to the invention has been carried out and the pressurised medium has been introduced into the drill-hole through the channel 15, 41, the medium 37 penetrates into the cavity or cavities that are present in the drill-hole and onwards out through any cracks that may be present in the neighbouring rock material.

The pressure or the flow of medium falls slowly if the cracks in the rock structure 2 are small.

The specific curve then displays a slow reduction in the pressure or flow of medium, and the crack or cracks in the rock structure are in this case classified as "small".

The pressure or the flow of medium falls rapidly if the cracks in the rock structure 2 are large.

The specific curve then displays a rapid reduction in the pressure or flow of medium, and the crack or cracks in the rock structure are classified as "large".

The channel 15, 41 for the introduction of the pressurised medium into the drill-hole has a volume that is filled by the pressurised medium before it penetrates out into the cavity. The initial change in pressure and change in flow of medium are therefore primarily an indication that the pressurised medium has penetrated into the channel and filled it. A continued change in at least one of pressure and flow of medium, during which the pressurised medium penetrates the cavity, demonstrates the presence of a cavity in the drill-hole.

Limiting values for the fall in pressure and the flow of medium during the initial phase can be calculated by one skilled in the arts, and they can be determined based on the dimensions of the channel, with the aid of, for example, the ideal gas law. When the limiting values for fall in pressure and flow of medium that have been calculated are passed, it has been ascertained that the detection of the presence of a cavity is correct.

Also the volume of the cavity can be determined using physical laws of gases and fluids, together with the pressure measured, $p_e$. The volume of the cavity, $V_k$, can be calculated in the case in which a gas is used as follows:

The ideal gas law states that $p*V=n*R*T$ (where T is considered to be constant).

From this, it can be derived that: $V_f*p_f=p_e*(V_k+V_f)$, where $p_f$ is the initial pressure in the container, $p_e$ is the final pressure in the container, $V_f$ is the volume of the pressure vessel, and $V_k$ is the volume of the cavity, including the volume of the channel.

Each drill-hole that has a reinforcement member with a channel or a tubular reinforcement member for the detection of cavities is checked and labelled, and the results of the measurements are stored in the computer. If the measurement is carried out after certain intervals of time, it is possible also to detect whether changes occur in the rock around the rock reinforcement arrangement. The rock structure should be further reinforced if a cavity is detected. It is possible that the density of the reinforcement members comprising a channel according to the invention can be increased within the test region. It is possible after rock reinforcement has been carried out to carry out periodic measurements using the measurement equipment and thus detect also whether changes in the rock structure around the rock reinforcement arrangement are taking place.

The channel 15, 41 may perform also other functions than that of introducing a medium into the drill-hole. A further function is that of, when a break in the reinforcement member or tubular reinforcement member is suspected, having an instrument or a thin wire 1101 introduced into the channel 15, 41 through the contact end 22, 46 in order to measure the distance to the break. The channel can also lead water out from the drill-hole, something that also may be an indication that the reinforcement member is broken and requires maintenance.

Through it being possible to carry out the method according to invention for the direct detection of the presence of cavities immediately after the rock reinforcement operation, the result of the method can be used also to determine whether the quantity of grout or its consistency is to be changed for the subsequent rock reinforcement operations in neighbouring regions.

Figure 9:
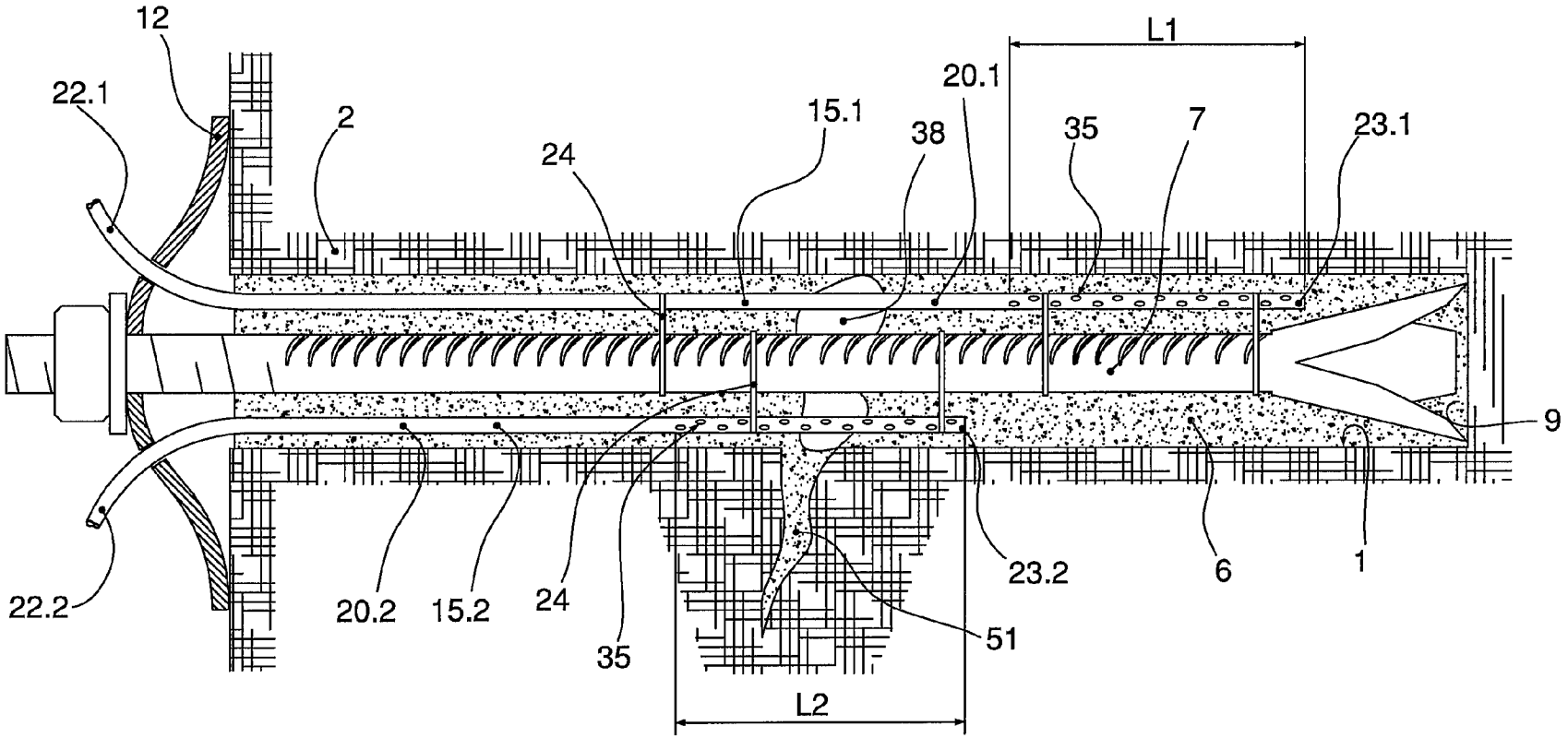
FIG. 9 illustrates a side view of a reinforcement member with two channels according to a fifth embodiment of invention.

FIG. 9 shows a fifth embodiment of the reinforcement member according to the invention. The reinforcement member in this embodiment comprises at least two channels 15.1, 15.2, which have different lengths. It is preferable that the first channel 15.1 be somewhat longer than the reinforcement member 7, in conformance with the embodiment shown in FIG. 1*d*. The second channel 15.2 is shorter than the first channel 15.1. Each channel 15.1, 15.2 has a contact end 22.1, 22.2 and an innermost end 23.1, 23.2. Each channel 15.1, 15.2 is arranged such that measurement equipment 25 can be connected to the contact end 22.1, 22.2 of the channel adjacent to the opening of the drill-hole such that a pressurised medium 37 can be introduced into the channel 15.1, 15.2.

By attaching at least a first channel 15.1 and a second channel 15.2 to the reinforcement member 7, where the channels have different lengths, and by carrying out the method according to the invention for the direct detection of the presence of a cavity, at least one of the position and the extent along the reinforcement member 7 in the drill-hole 1 of the cavity can be investigated and determined.

Each channel 15.1, 15.2 comprises a tube wall 20.1, 20.2, which is provided with at least one radially directed hole 35. It is preferable that the tube wall 20.1, 20.2 be provided with several radially directed holes 35.

It is preferable that each tube wall 20.1, 20.2 be provided with holes 35, that it be perforated, along a part L1, L2 of the complete length of the channel, of the tube wall. The tube wall 20.1 20.2 of the channel is, for example, provided with holes 35 from the innermost end 23.1, 23.2 of the channel to a distance of 1.5 meters along the tube wall of the channel. Good results are obtained if the tube wall of the channel is provided with holes 35 from the innermost end 23.1, 23.2 of the channel and for a distance of at least 20 cm along the tube wall of the channel. Thus, a major part of the wall 20.1, 20.2 of the tube of the channel is not provided with any radially directed holes.

The innermost end 23.1 of the first channel and the innermost end 23.2 of the second channel are arranged displaced relative to each other along the longitudinal direction of the drill-hole.

The perforated part L1 of the first channel 15.1 and the perforated part L2 of the second channel 15.2 are active in different parts of the longitudinal direction of the drill-hole.

The method for the direct detection of the presence of a cavity with this reinforcement member proceeds as follows: A drill-hole 1 is drilled into a rock structure 2, a portion of grout 6 is introduced into the drill-hole 1 and a reinforcement member 7 comprising two channels 15.1, 15.2 is introduced into the drill-hole 1 and fixed by an anchoring arrangement 12.

If there is a crack 51 in the rock structure 2 in the vicinity of the drill-hole 1, a part of the grout 6 normally runs into this crack and one or several cavities 38 arise in the drill-hole 1 in which there is no grout around the reinforcement member 7.

Measurement equipment 25 with a pressure gauge 27 is connected to the contact end 22.1 of the first channel 15.1 and a pressurised medium 37 such as nitrogen gas is introduced into the channel 15.1. The medium 37 penetrates out through the perforated tube wall, if there is a cavity next to this perforated tube wall.

The reinforcement member 7 and the channel 15.1 are, as shown in FIG. 9, surrounded by grout adjacent to the perforated part L1 of the channel 15.1. Thus, no significant fall in pressure is recorded by the pressure gauge 27. The measurement equipment 25 is subsequently connected to the contact end 22.2 of the second channel 15.2 and the measurement procedure is repeated.

A cavity 38 is present in the drill-hole 1, as shown in FIG. 9, adjacent to the reinforcement member 7 and the channel 15.2, adjacent to the perforated part L2 of the channel 15.2. The pressure gauge 27 thus records a fall in pressure and indicates in this way the presence of the cavity 38.

An indication of the location of the cavity in the drill-hole is obtained through knowledge of the position of the perforated part L2 of the channel 15.2, namely, in the direct vicinity of the perforated channel. The presence of a cavity 38 can in this way be detected, and the location of the cavity along the longitudinal direction of the drill-hole can be determined.

The reinforcement member can, of course, be provided with several channels. It is advantageous to have four, five, six, seven or eight channel fixed on the reinforcement member. The channels have, similarly to the above, different lengths and they are provided with radially directed holes. All channels are located and adapted such that the same effect as that described above is achieved.

It has proved to be very advantageous to carry out the direct method of measurement before the grout has completed the hardening process. The perforations have in this case normally not yet become clogged by hardened grout, and the medium penetrates the perforations in the tube wall if there is a cavity in the drill-hole adjacent to the outer surface of the tube wall of the channel.

Figure 10:
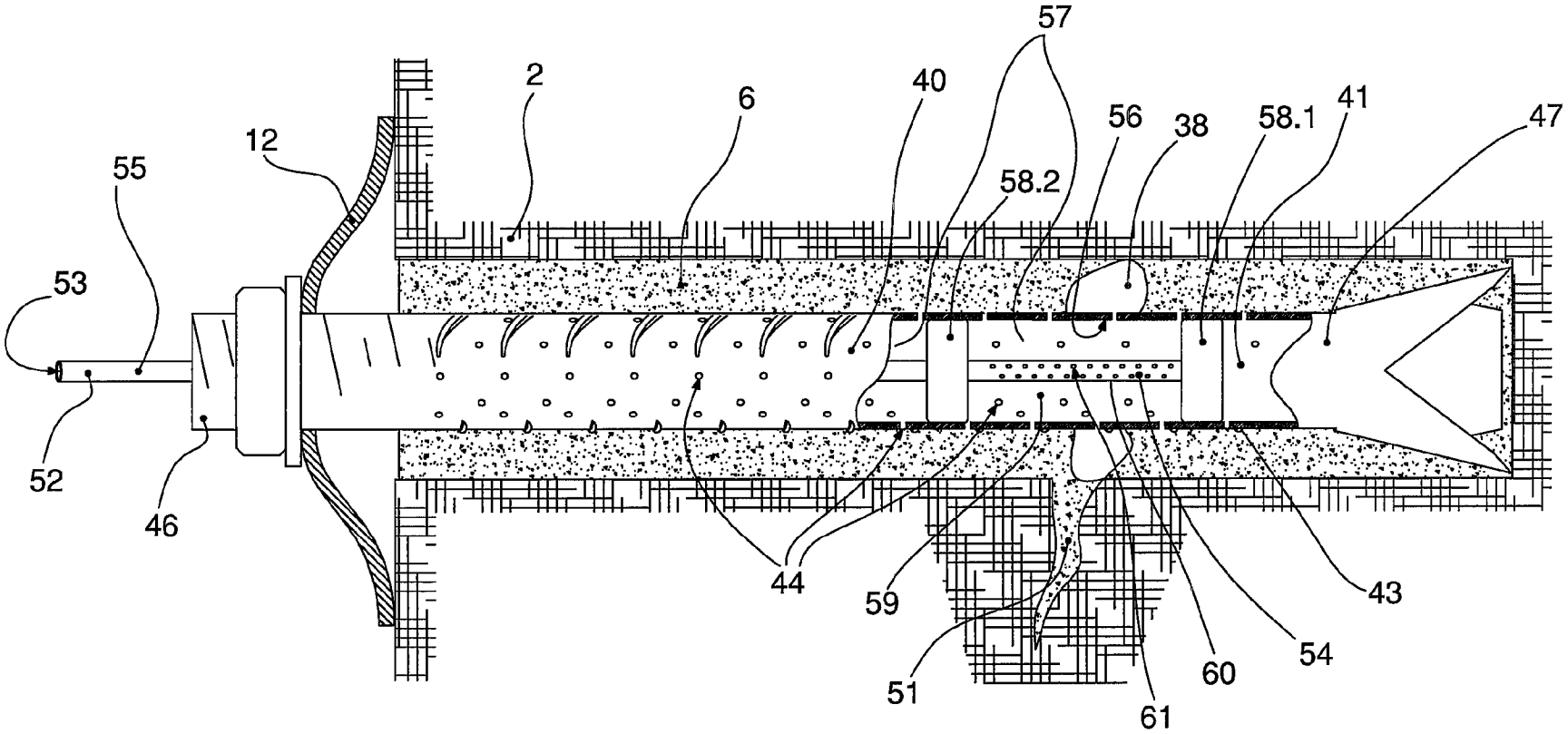
FIG. 10 illustrates a side view of a reinforcement member with a measurement probe according to a sixth embodiment of the invention.
Figure 11:
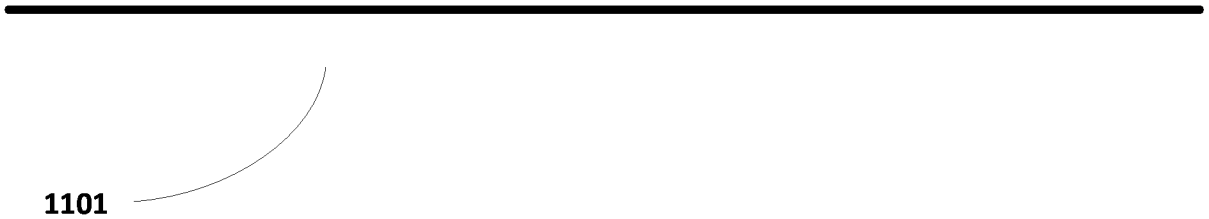
FIG. 11 illustrates an instrument or a thin wire for measuring a distance to a break in a reinforcement member.

FIG. 10 shows a sixth embodiment of the invention. The reinforcement member in this embodiment comprises a tubular reinforcement member 40 in accordance with previously described tubular reinforcement members. The tubular reinforcement member 40 comprises an open channel 41 and an inner surface 56. The tubular reinforcement member 40 is provided along its complete length with radially directed holes 44 or transverse channels. This embodiment of the invention is intended to be used not only for the detection of the presence of a cavity in a drill-hole, but also for the determination of the position of the cavity or crack in the rock structure along the longitudinal direction of the drill-hole 1.

A measurement probe 52 is introduced into the channel 41 and arranged such that it can be displaced. The measurement probe 52 comprises a measurement probe tube 53 with a first tube end 54 and a second tube end 55. The measurement probe tube is closed at the first tube end 54 and it is open at the second tube end 55.

The diameter of the measurement probe tube is smaller than the internal diameter of the channel 41, such that the measurement probe 52 can be introduced into the tubular reinforcement member 40 and displaced in the longitudinal direction inside it. The measurement probe 52 has a length that is at least equal to, or longer than, that of the tubular reinforcement member. A gap 57 is formed between the inner surface 56 of the tubular reinforcement member and the outer surface of the measurement probe tube 53.

The measurement probe 52 is provided with at least a first cuff 58.1. The first cuff 58.1 is arranged at the first tube end 54 and it surrounds the measurement probe tube 53. The measurement probe tube 53 comprises at least one radially directed hole 61.

FIG. 9 shows that the measurement probe 52 is provided with a first cuff 58.1 and a second cuff 58.2. The cuffs surround the measurement probe tube 53. The first cuff 58.1 is arranged at the first tube end 54. The cuffs are fixed by gluing or by shrinkage fitting onto the outer surface of the measurement probe tube 53. The second cuff 58.2 is arranged at a distance from the first cuff 58.1. The distance between the first and second cuffs is, for example, 10-50 cm. The first and second cuffs 58.1, 58.2 are dimensioned such that they seal the gap 57 and prevent gas or liquid from penetrating between the cuff and the inner surface 56 of the tubular reinforcement member 40. The cuffs are dimensioned for use at pressures up to at least 2 bar.

The cuffs are manufactured from, for example, a polyurethane elastomer, which has advantageous properties as a sealing material. A vulcanised polyurethane rubber, in particular, has good sealing properties at high pressure in an erosive environment.

The compartment between the measurement probe tube 53 and the inner surface 56 of the tubular reinforcement member and between the first cuff 58.1 and the second cuff 58.2 forms a measurement compartment 59.

The part of the measurement probe tube 53 that extends between the first cuff 58.1 and the second cuff 58.2 comprises at least one radially directed hole 61. It is preferable that the measurement probe tube 53 in the measurement compartment 59 be provided with several holes 61. The second tube end 55 of the measurement probe is designed to be connected to measurement equipment 25 for the direct detection of cavities as has been previously described.

In the case in which the measurement probe 52 is provided with only a first cuff 58.1, the gap between the measurement probe tube 53 and the inner surface of the tubular reinforcement member 56 forms a measurement compartment along the complete length of the measurement probe.

A second variant of this embodiment is one in which a channel 15, which in this case is perforated along its complete length, is fixed to a reinforcement member 7. The channel 15 in this case is dimensioned such that a thin measurement probe 52, provided with at least one cuff 58.1 in the manner described above, can be introduced into the channel 15 and displaced along the longitudinal direction of the channel. It is possible in this manner also to detect the location along the longitudinal direction of the drill-hole 1 of a cavity or crack in the rock structure when a reinforcement member 7 of kiruna bolt-type or similar is used.

The method for the direct detection of the presence of a cavity with a tubular reinforcement members 40 and a measurement probe according to FIG. 9 proceeds as follows:
A drill-hole 1 is drilled into a rock structure 2, a portion of grout 6 is introduced into the drill-hole and a tubular reinforcement member 40 is introduced into the grout. The measurement probe 52 is introduced into the channel 41 in the tubular reinforcement member 40 when carrying out the direct measurement of the presence of the cavity. The two cuffs 58.1, 58.2 seal the gap 57 between the measurement probe tube 53 and the inner surface 56 of the tubular reinforcement member 40. Measurement equipment 25 with a pressure gauge 27 is connected to the measurement probe 52. The measurement probe is introduced to a pre-determined distance from the opening of the drill-hole, for example, 1 metre into the channel 41. A pressurised medium 37, for example nitrogen gas, is introduced into the measurement probe 52. The medium 37 penetrates out through the holes 61 in the measurement probe tube 53 and fills the measurement compartment 59 between the cuffs 58.1, 58.2. A cavity 38 is present in the drill-hole 1, as shown in FIG. 10, adjacent to the tubular reinforcement member 40. The medium can therefore penetrate out from the measurement compartment 59 through the holes 44. The pressure gauge 27 thus records a fall in pressure and indicates in this way the presence of the cavity 38. The measurement probe is subsequently displaced a predetermined distance, for example 50 cm, inside the tubular reinforcement member 40 and a new measurement procedure is initiated. It is possible to determine the position along the longitudinal direction of the drill-hole of one or several cavities or cracks in the rock structure, or both, by repeatedly displacing the measurement probe along the longitudinal direction of the tubular reinforcement and repeating the measurement procedure. This method measures the fall in pressure in segments along the length of the drill-hole. It is also eminently possible to measure the fall in pressure accumulatively.

The method is carried out in a similar manner in the case in which the measurement probe 52 is provided with only one cuff 58.1.

The invention is not limited to what has been described above and shown in the drawings: it can be changed and modified in several different ways within the scope of the innovative concept defined by the attached patent claims.

The invention claimed is:

1. A method for the direct detection of the presence of a cavity in a drill-hole intended for the reception of a reinforcement member, which method comprises:

the injection of hardening grout into the drill-hole, the introduction of a reinforcement member into the drill-hole, the introduction of a pressurised medium into the drill-hole, and the measurement of a change in pressure in the medium or the detection of a flow of medium, whereby a fall in pressure or the presence of a flow of medium indicates the presence of a cavity.

2. A method according to claim 1, in which the medium is added through a channel that is comprised within the reinforcement member.

3. A method according to claim 1 where the channel is surrounded by the tube wall, and this tube wall comprises at least one radially directed hole through which the medium is added to the drill-hole at the presence of a cavity.

4. A method according to claim 1, where the opening is covered by a cover before the reinforcement member and the channel are introduced into the drill-hole.

5. A method according to claim 1, where the channel is fixed to the reinforcement member before the reinforcement member is introduced into the drill-hole.

6. A method according to claim 1, where the fall in pressure or the flow of medium is measured and used to calculate the volume of a cavity that has been detected.

7. A method according to claim 1, where an instrument is introduced into the channel in order to detect breakage of the reinforcement member.

8. A method according to claim 1, where a specific curve that displays the change in pressure or flow of medium is produced, and where the specific curve is used to classify a crack in a rock structure adjacent to the drill-hole.

9. A method according to claim 1, where a measurement probe is introduced into the channel in order to determine the location of a cavity in the longitudinal direction of the drill-hole.

10. A system for the direct detection of the presence of a cavity in a drill-hole intended for the reception of a reinforcement member comprising an extended reinforcement member characterised in that the system comprises a container comprising a pressurised medium, that the reinforcement member comprises a channel through which the pressurised medium in the container is supplied to the drill-hole at the presence of a cavity, and a pressure gauge or a flow meter where the pressure gauge measures a change in pressure or the flow meter detects a flow of medium, whereby a fall in pressure or a flow of medium indicates the presence of a cavity.

11. A use of a system according to claim 10 for the direct detection of the presence of a cavity in a drill-hole intended for the introduction of a reinforcement member.

12. A system according to claim 10, where the channel is tubular and attached to the reinforcement member.

13. A system according to claim 10, where the tubular reinforcement member has the form of a wave along a part of its length.

14. A system according to claim 10, where the pressurised medium comprises nitrogen gas.

15. A system according to claim 10, comprising a thin wire for the detection of breaks in the reinforcement member.

16. A system according to claim 10, comprising a measurement probe adapted such that it can be displaced in the channel, where the measurement probe comprises a measurement tube that is provided with at least a first cuff and where the measurement probe comprises at least one radially directed hole.

17. A system according to claim 16, where the measurement tube is provided with a first cuff and a second cuff, and where the part of the measurement tube that extends between the first cuff and the second cuff comprises at least one radially directed hole.

18. A system according to claim 10 where the channel is surrounded by a tube wall, and the tube wall comprises at least one radially directed hole through which the medium is added to the drill-hole at the presence of a cavity.

19. A system according to claim 18, where the reinforcement member consists of a tubular reinforcement member and the channel is an integral part of the tubular reinforcement member.

20. A reinforcement member arrangement for use in the direct detection of the presence of a cavity in a drill-hole intended for the reception of a reinforcement member, the reinforcement member arrangement comprising:

a reinforcement member comprising a channel for the introduction of a medium into the drill-hole, wherein the channel is surrounded by a wall comprising at least one radially directed hole, and an anchor configured to engage the reinforcement member and configured to secure the reinforcement member to a rock structure.

21. A reinforcement member arrangement according to claim 20, where the reinforcement member comprises at least two channels that have different lengths.

22. A reinforcement member arrangement according to claim 20, wherein the channel extends along the whole length of the reinforcement member and wherein the wall comprises a plurality of radially directed holes distributed along the whole length of channel.

23. A reinforcement member arrangement according to claim 20, further comprising a cover over at least a portion of the reinforcement member, the cover covering the at least one radially directed hole.

24. A reinforcement member arrangement according to claim 20 where the channel is fixed to the reinforcement member.

25. A reinforcement member arrangement according to claim 24, whereby the channel is an integral part of the reinforcement member.

* * * * *